United States Patent [19]

Moore, Jr. et al.

[11] Patent Number: 4,502,623

[45] Date of Patent: Mar. 5, 1985

[54] PRECISE VOLUME, DISPOSABLE FOOD CONTAINER

[76] Inventors: Franklin Moore, Jr., 902 McBurney Dr., Lebanon, Ohio 45036; Clinton Fultz, 508 Preston Dr., Waynesville, Ohio 45068

[21] Appl. No.: 405,073

[22] Filed: Aug. 4, 1982

[51] Int. Cl.[3] ..... B65D 5/18

[52] U.S. Cl. ..... 229/1.5 B; 206/499; 229/8; 294/55

[58] Field of Search ..... 221/303, 304, 307–310, 221/47, 63; 312/43; D7/6; 229/8, 21, 41 R, 41 B, 1.5 B, 16 R, 33; 294/55; 206/499

[56] References Cited

U.S. PATENT DOCUMENTS

| | | | |
|---|---|---|---|
| 2,305,349 | 12/1942 | Goodwin | 229/33 X |
| 2,337,199 | 12/1943 | Holy | 229/16 R X |
| 3,125,258 | 3/1964 | Watts | 229/8 X |
| 3,630,430 | 12/1971 | Struble | 229/16 R |
| 3,837,561 | 9/1974 | Rubin | 229/23 BT |
| 3,877,632 | 4/1975 | Steel | 229/1.5 B X |

FOREIGN PATENT DOCUMENTS

| | | | |
|---|---|---|---|
| 721141 | 11/1965 | Canada | 229/33 |
| 2411134 | 8/1979 | France | 229/33 |
| 35906 | 2/1935 | Netherlands | 229/33 |

*Primary Examiner*—William Price
*Assistant Examiner*—Gary E. Elkins
*Attorney, Agent, or Firm*—Jacox & Meckstroth

[57] ABSTRACT

A disposable container for serving a food product, such as french-fried potatoes or the like, particularly in a fast-food establishment. The disposable container is constructed from a single piece or blank of paperlike material or light card stock material. The blank has a front panel, a back panel, and a bottom panel, the back panel has a pair of extending side sections which are folded to a position substantially normal to the back panel. Each of the side sections has portions which engage the front panel and the bottom panel to establish a predetermined spacing between the front panel and the back panel. Thus, a predetermined volume is established in the disposable container.

2 Claims, 11 Drawing Figures

FIG-9
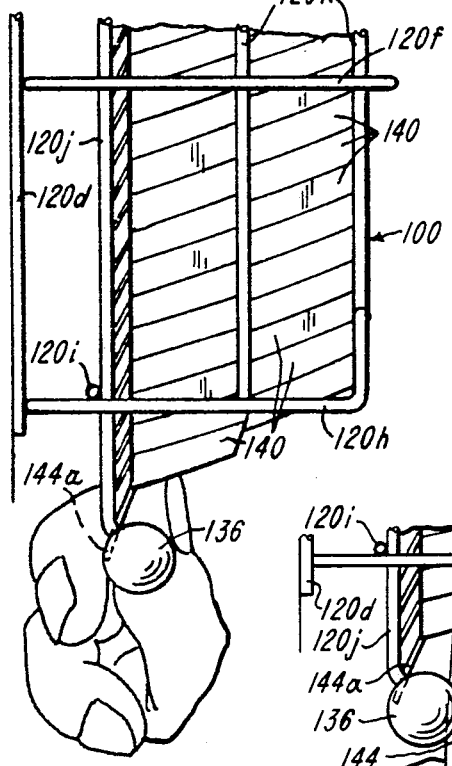
FIG-10
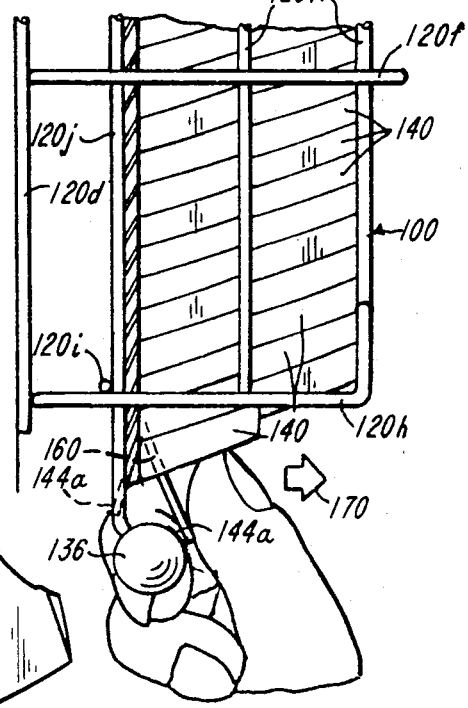
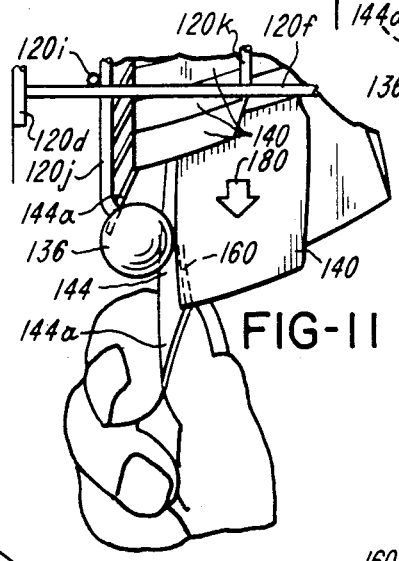
FIG-11
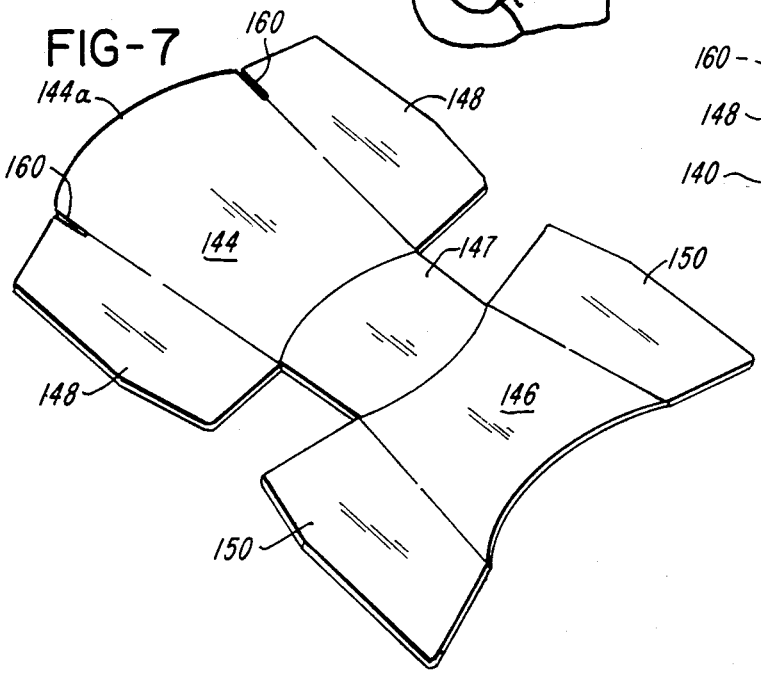
FIG-7
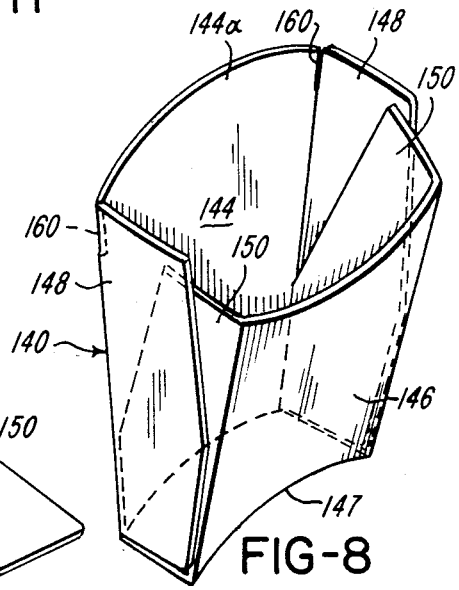
FIG-8

PRECISE VOLUME, DISPOSABLE FOOD CONTAINER

BACKGROUND OF THE INVENTION

In most fast-food establishments, food such as french-fried potatoes are sold. French-fried potatoes are conventionally served in disposable paper or paperlike cups or containers. An attendant fills the containers as orders for the french-fried potatoes are placed. Management desires that a given predetermined quantity of french-fried potatoes is served with each order therefor. Because of the high volume of sales of such paper cups or containers to those who operate fast-food establishments, the paper cups or containers are produced in large quantities by automatically operating machines.

In the past, the paper cups or food containers produced by such automatically operating machines have not been consistent in size. Thus, the volumetric capacity of the cups or containers has varied. Therefore, when an attendant fills the paper cups or containers, the quantities served are not consistent. Some customers may receive a larger quantity of french-fried potatoes than management intends, and some customers may receive a smaller quantity of french-fried potatoes than management intends.

It is, therefore, an object of this invention to provide a disposable paper cup or container for use in serving foods, such as french-fried potatoes or the like, in which such cups or containers can be mass produced and in which each cup or container has the same capacity.

It is another object of this invention to provide a method of production of such cups or containers.

Other objects and advantages of this invention reside in the construction of the cups or containers, the method of production, and the mode of use, as will become more apparent from the following description.

SUMMARY OF THE INVENTION

A paper cup or container of this invention is produced from a piece of flat semi-rigid sheet of paper or paperlike material or card stock of the like, in which the piece consists of a blank which is accurately cut to a predetermined shape and dimensions, ready for folding and glueing. The piece is scored to enable folding thereof to be readily performed. The piece includes several fold parts to form front, back and bottom panels of the container. The front panel has a pair of opposed extending side sections, and the back panel has a pair of opposed extending side sections or flaps. Each of the side sections or flaps which extend from the back panel has a precisely formed edge which, upon folding, engages the front panel of the piece, as the lower edge of the side sections or flaps engages the bottom panel. The side sections of the front panel are folded and partially cover the side sections of the back panel, and are adhesively attached to the side sections of the back panel. Thus, the container is precisely formed to a predetermined size and has a precise predetermined volume.

BRIEF DESCRIPTION OF THE VIEWS OF THE DRAWING

FIG. 7 is a perspective view, similar to FIG. 5, and illustrating a modification in the container or cup of this invention.

FIG. 8 is a perspective view, similar to FIG. 3, illustrating the container or cup of FIG. 7.

FIG. 9 is a fragmentary elevational view, drawn on a slightly larger scale than FIGS. 7 and 8, and illustrating a stack of the containers of FIGS. 7 and 8 in a retainer and dispenser structure and illustrating an initial step in removal of a container from the retainer and dispenser structure.

FIG. 10 is a fragmentary elevational view similar to FIG. 9, illustrating a succeeding step in removal of a container from the retainer and dispenser structure.

FIG. 11 is a fragmentary elevational view, similar to FIGS. 9 and 10, illustrating a succeeding step in removal of a container from the retainer and dispenser structure.

PRIOR ART

Figure 1:
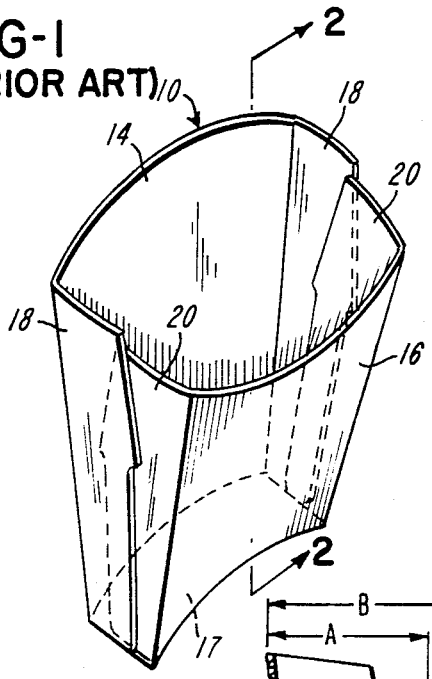
FIG-1 (PRIOR ART)
FIG. 1 is a perspective view of a cup or container produced in accordance with the prior art.
Figure 2:
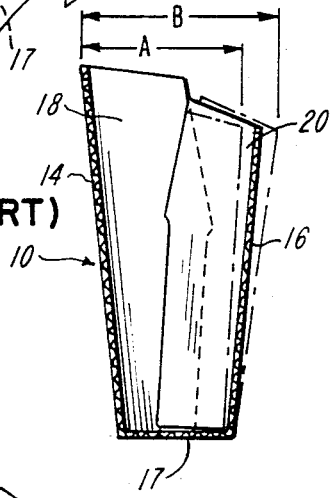
FIG-2 (PRIOR ART)
FIG. 2 is a sectional view taken substantially on line 2—2 of FIG. 1.

FIGS. 1 and 2 illustrate a cup or container 10 produced in accordance with the prior art. The cup 10 has a front panel 14, a back panel 16, and a bottom panel 17. The bottom panel 17 joins the front panel 14 to the back panel 16. The front panel 14 has side sections 18 folded substantially normal to the front panel 14. The back panel 16 has side sections 20 which are folded substantially normal to the back panel 16. In the production of the cup 10, the side sections 18 and 20 are brought together, after folding thereof. The side sections 18 and 20 are brought together to any position in which a part of the side sections 20 are enclosed by the side sections 18. There is no fixed position for the side sections 18 with respect to the side sections 20. The side sections 18 and 20 are then glued together.

Due to the fact that there is no predetermined position of the side sections 18 with respect to the side sections 20, the front panel 14 and the back panel 16 may be at a minimum dimension "A" therebetween or at a maximum dimension "B" therebetween, as illustrated in FIG. 2. Therefore, the cup 10 has a relatively small capacity when the spacing between the panels 14 and 16 is as illustrated by dimension "A", or the cup 10 has a relatively large capacity when the spacing between the panels 14 and 16 is as illustrated by the dimension "B". Therefore, when the cup 10 of the prior art is used in a fast-food establishment to contain french-fried potatoes or the like, the quantity of the food contained therein may be relatively small when the dimension "A" exists and may be relatively large when the dimension "B" exists. As stated above, management of the fast-food establishment desires that each cup or container employed to contain food have the same capacity. Therefore, management objects to cups 10 made according to the prior art.

DETAILED DESCRIPTION OF THIS INVENTION

Figure 3:
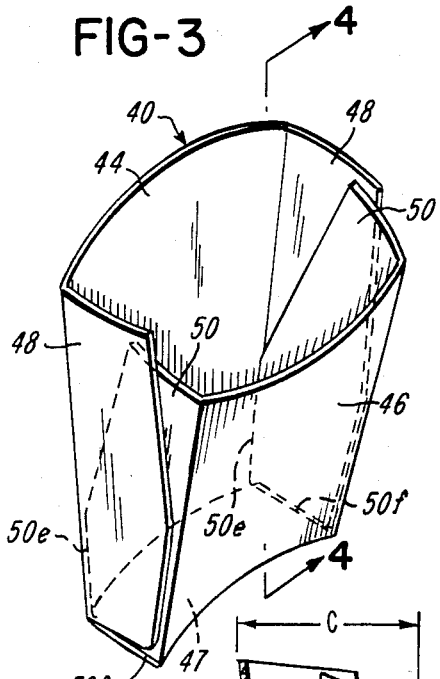
FIG. 3 is a perspective view, similar to FIG. 1, but illustrating a cup or container produced in accordance with this invention.

A cup or container 40, illustrated in FIG. 3, and produced in accordance with this invention, comprises a front panel 44, a back panel 46, and a bottom panel 47. The bottom panel joins the front panel 44 to the back panel 46. The front panel 44 has side sections or flap portions or extendion portions 48, and the back panel 46 has side sections or flap portions or extension portions 50. The front panel 44 is shown as being longer than the back panel 46. However, the front panel 44 and the back panel 46 may have the same dimensions, if so desired.

Figure 5:
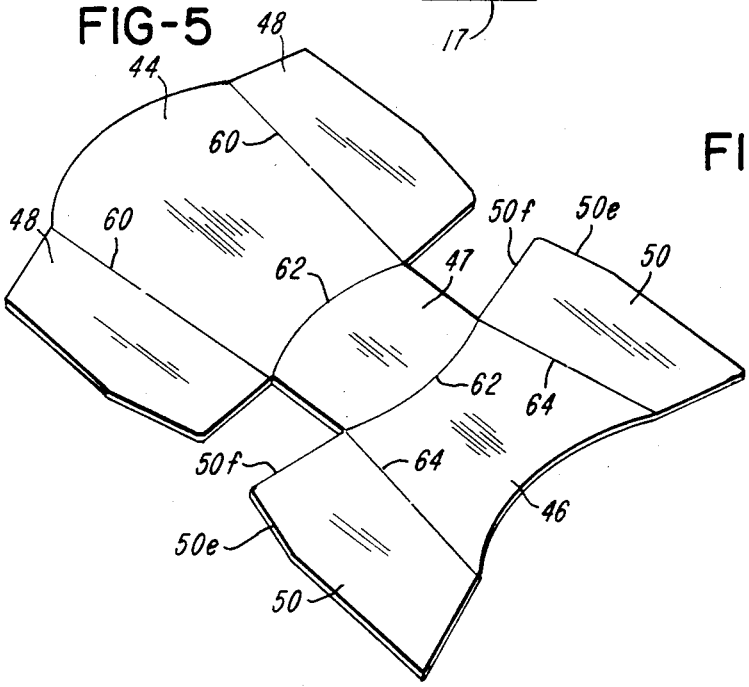
FIG. 5 is a perspective view of a piece of paper or paperlike material or card stock material cut from a sheet of the material as a step in formation of a cup or container in accordance with this invention.

FIG. 5 shows a first step in the production of the cup or container 40, as the cup or container 40 comprises a single piece or blank of paper or paperlike material or card stock material or the like. The piece is cut from a larger sheet thereof. Score lines or fold lines 60 separate the side sections 48 from the front panel 44. Score lines 62 separate the bottom panel 47 from the front panel 44 and from the back panel 46. Score lines or fold lines 64 separate the back panel 46 from the side sections 50.

Figure 4:
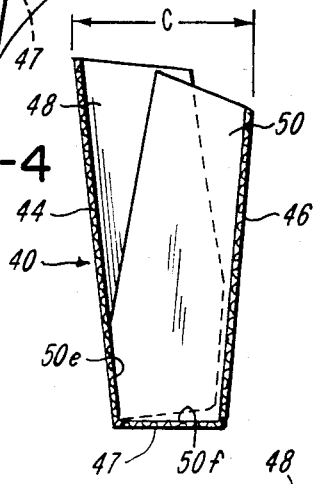
FIG. 4 is a sectional view taken substantially on line 4—4 of FIG. 3.
Figure 6:
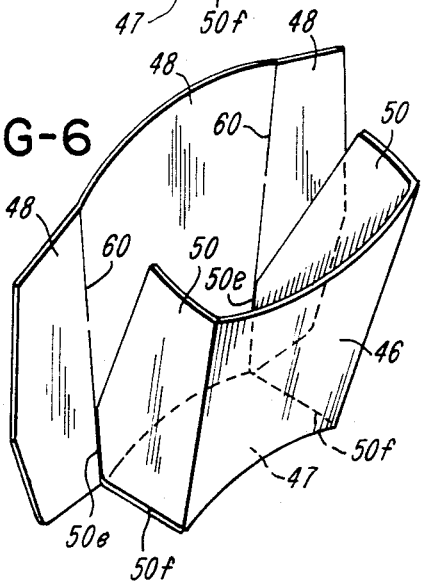
FIG. 6 is a perspective view, illustrating another step in construction of a cup or container in accordance with this invention.

Each of the side sections 50 of the back panel 46 has an angular straight edge **50*e* and a lower edge 50*f*. As illustrated in FIGS. 3, 4, and 6, as the cup or container 40 is formed, the side sections 50 are moved toward the front panel 44 until the edges 50*e* engage the inner surface of the front panel 44 at the score lines 60. In this position of the side sections 50, the lower edges 50*f* are normally in engagement with the bottom panel 47. Then the side sections 48 of the front panel 44 are brought into enclosing relationship to the side sections 50 of the back panel 46, as best illustrated in FIG. 3. Then the side sections 48 are glued to the side sections 50. Therefore, a predetermined dimension "C" exists between the front panel 44 and the back panel 46 in each cup or container 40 produced, as illustrated in FIG. 4. Thus, each cup or container 40 has a predetermined shape and capacity, as the edges 50*e*** for containing a food product, such as french-fried potatoes or the like, or for containing any other suitable substance or material.

FIGS. 7–10

FIGS. 7 and 8 illustrate a modification in the container or cup of this invention. A container or cup 140 shown in FIG. 8 is particularly adapted to be retained and dispensed by a retainer and dispenser unit 100, shown in FIGS. 9 and 10. The retainer and dispenser unit 100 is preferably of the type disclosed in application Ser. No. 348,350, filed Feb. 12, 1982.

The retainer and dispenser unit 100 comprises wire members **120*d*, 120*f*, 120*i*, 120*j*, 120*k*, and 120*h*, which are attached together to retain a stack of containers or cups 140, in the manner disclosed in patent application 348,350, as each of the containers 140** in the stack thereof is inverted.

Each of the containers or cups 140 has a front panel 144, a back panel 146, and a bottom panel 147. The front panel 144 has side sections 148 folded substantially normal to the front panel 144. The back panel 146 has side sections 150 which are folded substantially normal to the back panel 146. In the production of the container 140 the side sections 148 and 150 are brought together, after folding thereof and are then glued together in a manner discussed with respect to the container 40 of FIGS. 4, 5, and 6.

The front panel 144 is partially separated from the side sections 148 by slots 160. The slots 160 thus provide a flap portion **144*a* which is easily and readily deflected from the other portions of the front panel 144. Therefore, when it is desired to remove a container 140 from the retainer and dispenser unit 100, the portion 144*a* is grasped, as illustrated in FIG. 9 and deflected from abutment members 136 of the retainer and dispenser unit 100, as illustrated by an arrow 170 in FIG. 10. The lowermost container 140 is then easily removed from the retainer and dispenser unit 100 as the flap portion 144*a* is deflected and moved from the abutment members 136 and as the lowermost container 140 is drawn downwardly from the stack of containers 140, as illustrated by an arrow 180 in FIG. 11**.

Although the preferred embodiment of the food container of this invention has been described, it will be understood that within the purview of this invention various changes may be made in the form, details, proportion and arrangement of parts, the combination thereof, and the mode of production, which generally stated consist in a food container within the scope of the appended claims.

The invention having thus been described, the following is claimed:

1. A disposable open top container for collecting and serving a food product and adapted to be used in a fast-food establishment, the container comprising:

a unitary piece of paper-like material including a front panel and a back panel connected by a bottom panel, the front panel having a projecting lip portion with an upwardly curved upper edge to form a scoop and the back panel having a downwardly curved upper edge, a pair of opposed side walls connected to the front panel and projecting therefrom at substantially right angles, a pair of opposed side walls connected to the back panel and projecting therefrom at substantially right angles, each of the side walls projecting from one of the panels having a first edge portion and a second edge portion forming an obtuse angle therebetween, the first edge portions of the side walls having a length generally equal to the spacing between the front and back panels adjacent the bottom panel and engaging the other of the panels for precisely spacing the back panel with respect to the front panel to determine the volumetric capacity of the container, the second edge portions of the side walls diverging from the one panel towards the plane of the other panel, the side walls projecting from the other panel overlapping the side walls projecting from the one panel and being adhesively attached thereto to fix the relative positions of the panels, each of the side walls projecting from the other panel having an edge portion diverging from the one panel towards the plane of the other panel, the front panel having a pair of slots extending from the open top on opposite ends of the lip portion and partially separating the front panel from the side walls projecting therefrom, the slots providing a spring-like deflectable lip portion to facilitate separating the container from an adjacent container within a stack of nested containers.

2. A disposable open top container for collecting and serving a food product and adapted to be used in a fast-food establishment, the container being arranged in a vertical stack of the containers disposed in inverted nested relation and retained within a dispenser unit with the lowermost container in the stack engaging an abutment located at the bottom of the dispenser unit, comprising:

a unitary piece of paper-like material including a front panel and a back panel connected by a bottom panel, the front panel having a lip portion projecting beyond the back panel to form a scoop, a pair of opposed side walls foldably joined to the front panel and extending substantially at right angles from the front panel, a pair of opposed side walls foldably joined to the back panel and extending substantially at right angles from the back panel, each of the side walls of one of the panels having a first edge portion and second edge portion forming an obtuse angle therebetween, the first edge portions of the side walls engaging the other of the panels for precisely spacing the back panel with respect to the front panel to determine the volumetric capacity of the container, the side walls of the other panel at least partially enclosing the side walls of the one panel and being adhesively attached thereto to fix the relative positions of the panels, the lip portion on the front panel of the lowermost container in the stack engaging the abutment on the dispenser unit and being flexible toward the back panel and around the abutment to release the lowermost container from the stack of inverted containers in a dispenser unit, the front panel having a pair of slots extending from the open top on opposite ends of the lip portion and partially separating the front panel from the side walls projecting therefrom, the slots providing a spring-like deflectable lip portion to facilitate separating the container from the adjacent container within the stack of nested containers.

* * * * *